United States Patent [19]

Burton et al.

[11] Patent Number: 4,516,699

[45] Date of Patent: May 14, 1985

[54] AUTOMATIC LADLING APPARATUS

[75] Inventors: Charles A. Burton; Peter Banovic, both of Columbus, Ohio

[73] Assignee: Yellowstone Ltd., Columbus, Ohio

[21] Appl. No.: 503,164

[22] Filed: Jun. 10, 1983

[51] Int. Cl.[3] ..... B22D 41/12

[52] U.S. Cl. ..... 222/591; 222/629; 222/357; 414/706; 414/733

[58] Field of Search ..... 414/709, 706, 707, 733, 414/917; 901/15, 21; 222/604, 591, 629, 356, 357

[56] References Cited

U.S. PATENT DOCUMENTS

| | | | |
|---|---|---|---|
| 2,815,138 | 12/1957 | Noffsinger | 214/140 |
| 3,400,862 | 9/1968 | Watanabe | 222/333 |
| 4,289,259 | 9/1981 | O'Brien | 222/590 |
| 4,441,852 | 4/1984 | Dixon | 414/733 |

*Primary Examiner*—Joseph J. Rolla
*Assistant Examiner*—Nils E. Pedersen
*Attorney, Agent, or Firm*—Pearne, Gordon, Sessions, McCoy, Granger & Tilberry

[57] ABSTRACT

An automatic ladling apparatus for conveying molten metal from a furnace to a die casting machine or the like. The ladle dipper is carried through its ladling cycles by means of cooperating link assemblies mounted on an upright base or pedestal. The assemblies include a motion generating link assembly having a generating arm with an outer end adapted to move through a generally horizontal path with a downwardly curved vertical portion at one end. The other end of the generating arm is connected to a crank arm mounted on a crankshaft that is turned by an appropriate drive through a Geneva motion mechanism. The motion of the generator arm is further controlled by a rocking link connected between the arm and the base. The outer end of the generator arm is connected to a second link assembly that includes a main link connected at one end to the base and a carrier link connected to the main link at one end and adapted to carry the ladle dipper at its other end. The attitude (i.e., tilt angle) between fill, transport, and pour positions is controlled through a chain and sprocket mechanism extending through the main link and carrier link and by a cam link and crank arrangement controlled alternately by the crankshaft movement and by the rocking link movement to coordinate the ladle attitude with the path of travel between the furnace and the die casting machine.

17 Claims, 21 Drawing Figures

30
31
32
22
20
2
52
18
21
111
66
16
64
17
14
2
93
70
78
50
91
62
65
14
92
15
84
L
86
96
68
63
12
10
13
11
L
F

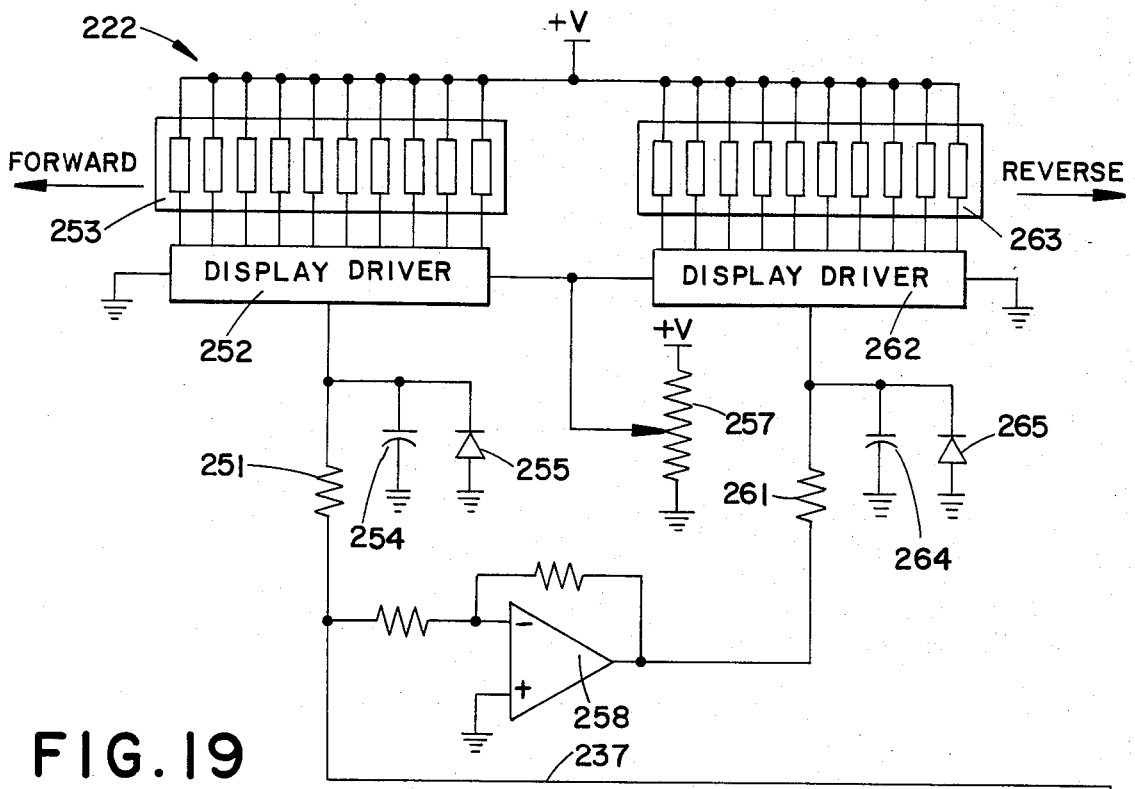
FIG. 19
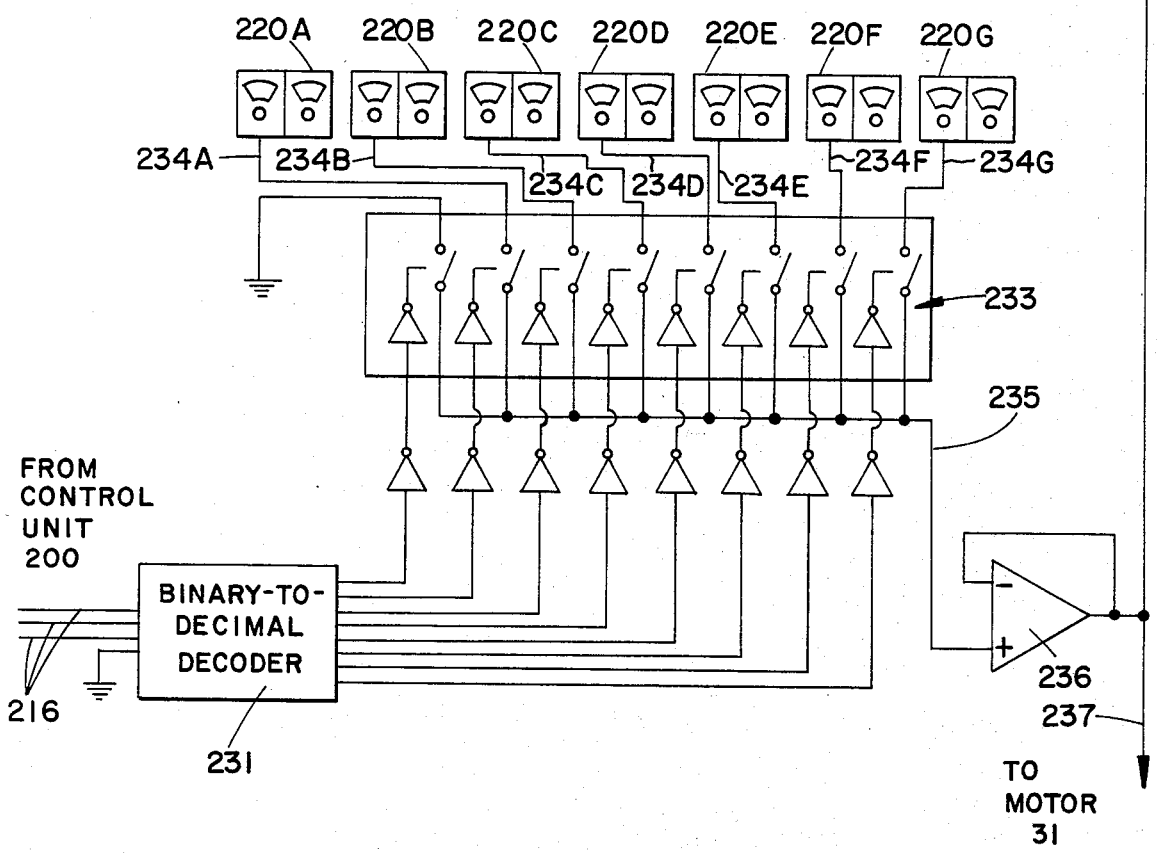

AUTOMATIC LADLING APPARATUS

BACKGROUND OF THE INVENTION

This invention relates to the pouring of molten metal such as aluminum into a molding apparatus, such as a die casting machine. More particularly, the invention relates to a ladling apparatus operative to mechanically receive a measured charge of molten metal from a holding furnace or crucible, transport it a desired distance, and pour it into the molding apparatus preparatory to the molding operation, and especially to an automatic ladling machine specifically adapted for use in association with die casting machines.

This invention relates to and incorporates by reference herein the disclosure of the U.S. patent application of Ronald D. Shriver, entitled "CONTROL SYSTEM FOR AUTOMATIC LADLING APPARATUS," filed of even date herewith.

Automatic ladling devices generally comprise a conveyor mechanism with a ladle dipper attached thereto and adapted to be conveyed thereby between a crucible or furnace and a die casting machine. The ladle dipper automatically descends into the furnace to draw a supply of molten metal and is then transported by the conveying mechanism from the furnace to the die casting machine, where the metal is poured into an appropriate receiver.

A typical ladling apparatus of this type is disclosed in U.S. Pat. No. 3,923,201.

In the prior art, the ladling apparatus is installed for use in association with a specific furnace and die casting machine, the installation requiring careful positioning and adjustment of heights and the like so that the path of travel of the ladle dipper is carefully matched to the furnace and die casting machine locations. The installation and adjustment are time-consuming operations and, once completed, are difficult to change. Often, however, due to changes in molds, furnaces, and the like in the die casting facility, a change in direction is necessary, all of which requires extensive adjustment of the ladling apparatus.

The ladling apparatus of the present invention, however, provides greatly improved adjustability and flexibility and affords many other features and advantages heretofore not obtainable.

SUMMARY OF THE INVENTION

It is among the objects of the present invention to provide improved accuracy in the transporting of molten metal from a furnace to a die casting machine.

Another object is to provide improved reliability in such a machine as well as safety features that minimize malfunctions and loss of castings due to defects.

These and other objects and advantages are obtained with the novel ladling apparatus of the present invention, which includes a link assembly adapted to transport a ladle dipper in a controlled attitude from a crucible to the mold assembly where the metal is poured into an appropriate receiver. The link assembly includes a motion generating mechanism that includes a crankshaft journaled in the base, a crank arm connected to the crankshaft, and a generating arm pivotally connected at one end to the outer end of the crank arm and at the other end to a second link mechanism adapted primarily to greatly enlarge the path of motion generated by the generating arm. The movement of the generating arm is controlled in part by a rocking link pivotally connected at one end to the base and at the other end to the generating arm intermediate its ends. The motion generating mechanism is driven by an appropriate power transmission means through a Geneva motion mechanism which provides dwell periods at the respective ends of the path of travel.

The second link mechanism includes a main link pivotally connected to the base and a carrier link pivotally connected at one end to the main link and adapted to carry the ladle dipper at the other end. The motions of the main link and the carrier link are controlled by two additional links, one of which is connected between a connection point on the main link and the generating arm and the other of which is connected at one end to the carrier link intermediate its ends and at the other end to the generator arm.

The control of the attitude or tilt of the ladle dipper is accomplished by means of a chain and sprocket mechanism that extends through the main link and the carrier link and which is operatively associated with the crank arm that drives the generating arm and (through a cam mechanism) with the rocking link connected to the generating arm.

Accordingly, the ladle dipper is carried through a path of travel that includes a generally horizontal span with the pouring performed at one end thereof and a downwardly curved generally vertical portion at the other end of the horizontal span wherein the ladle dipper is lowered into the molten metal contained in the furnace reservoir.

The control mechanism for the apparatus includes an abort system that operates in association with the ladle tilt control mechanism to pour molten metal from the ladle dipper back into the furnace whenever a "not-ready-to-pour" condition is sensed.

BRIEF DESCRIPTION OF THE DRAWINGS

FIG. 19 is a schematic diagram of a portion of FIG. 18 showing the motor control circuit;

DESCRIPTION OF THE PREFERRED EMBODIMENT

Figures 1, 2:
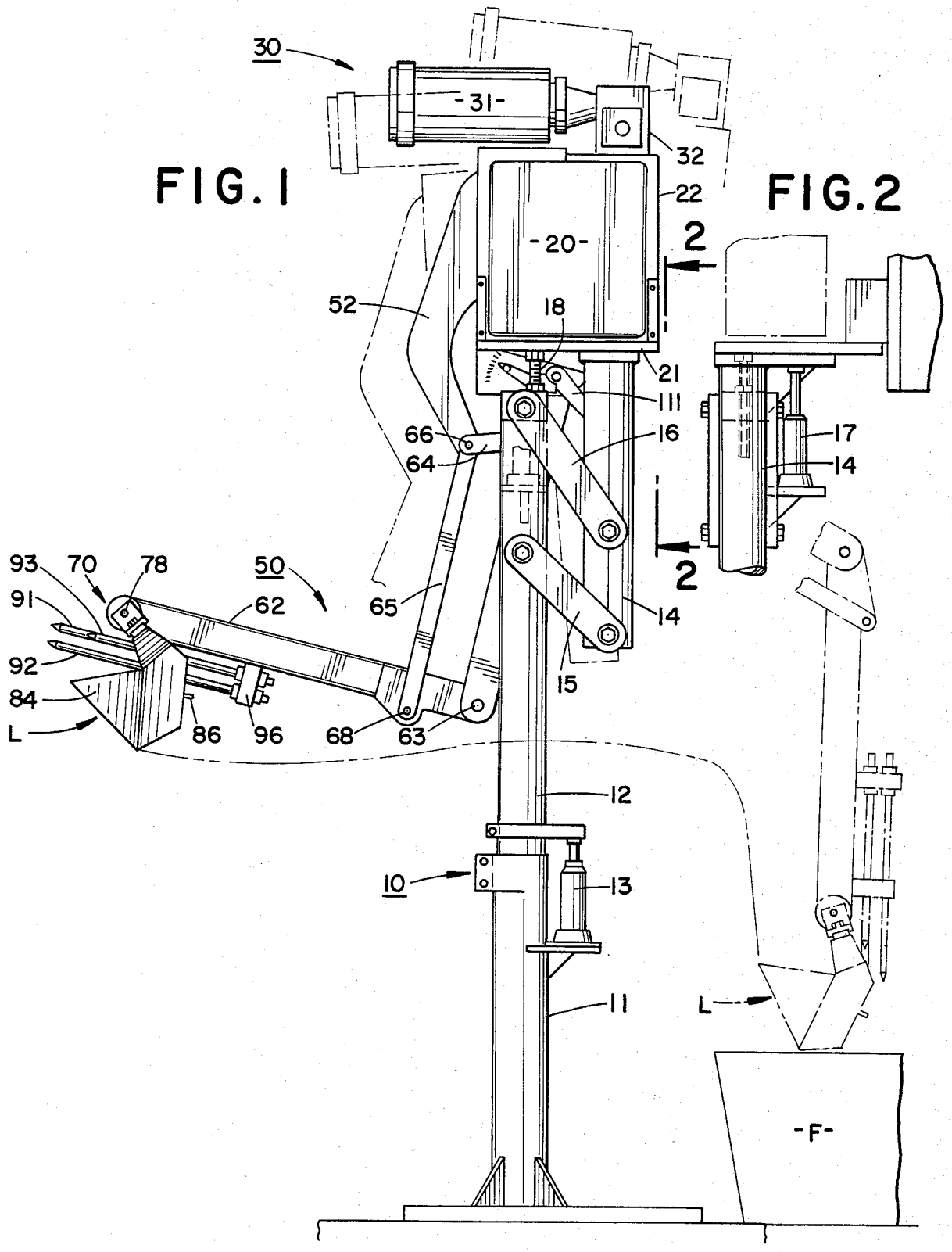
FIG. 1 is a side elevational view of an automatic ladling apparatus embodying the invention.
FIG. 2 is a fragmentary elevation of the apparatus of FIG. 1, taken on the line 2—2 of FIG. 1.

Referring more particularly to the drawings, and initially to FIGS. 1 through 6, there is shown an apparatus for transporting a ladle dipper L adapted to contain a charge of molten metal, in a controlled path of travel between a furnace F and an appropriate receiver in a die casting machine D. The apparatus includes as basic components a pedestal assembly 10 that supports a drive assembly 30, which in turn operates a ladle transport assembly 50, and a ladle tilt assembly 100.

Pedestal Assembly

The pedestal assembly 10 includes a generally vertical base tube 11, an upper tube 12 slidably received in the base tube 11, and an adjusting cylinder 13 adapted to raise and lower the upper tube 12 relative to the base tube 11 for the purpose of adjusting the apparatus relative to the furnace height.

Located adjacent and generally parallel to the upper tube 12 is a support tube 14 connected to the upper tube by a pair of links 15 and 16 of unequal length and adapted to be adjusted vertically relative to the upper tube 12 by a pour position adjusting cylinder 17. The lengths of the links 15 and 16 are so selected that as the height of the support tube 14 is changed relative to the upper tube 12, the main housing 20 tilts relative to the base tube 11, as illustrated in dashed lines in FIG. 1. Accordingly, when the ladle dipper L is supported in the receiving position relative to the furnace F, its position is relatively unchanged. On the other hand, the vertical position of the ladle dipper L relative to the receiver for the die casting machine D may be adjusted as necessary. Once the pour position adjusting cylinder 17 has been operated to place the support tube 14 in a desired position, a threaded stop screw 18 may be tightened against the bottom of the main housing 20 to provide a positive stop.

The main housing 20 includes a pair of vertical, parallel side plates 22 and 23 (FIG. 8) located relative to one another by spacer plates 25 and 26. The side plate 22 has a curved slot 24 formed therein for use in connection with the "not-ready-to-pour" abort system described below. Also each of the side plates 22 and 23 has several corresponding bores formed therein for bearings in which the various shafts of the drive assembly 30 are journaled.

Drive Assembly

Figure 8:
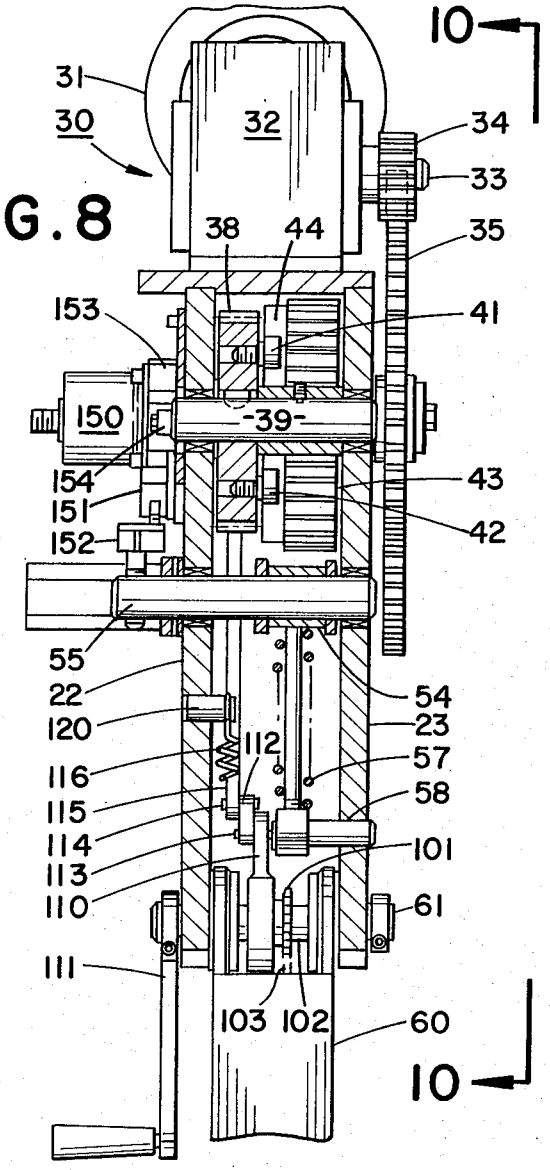
FIG. 8 is a fragmentary, sectional view taken on the line 8—8 of FIG. 7.
Figures 9, 11:
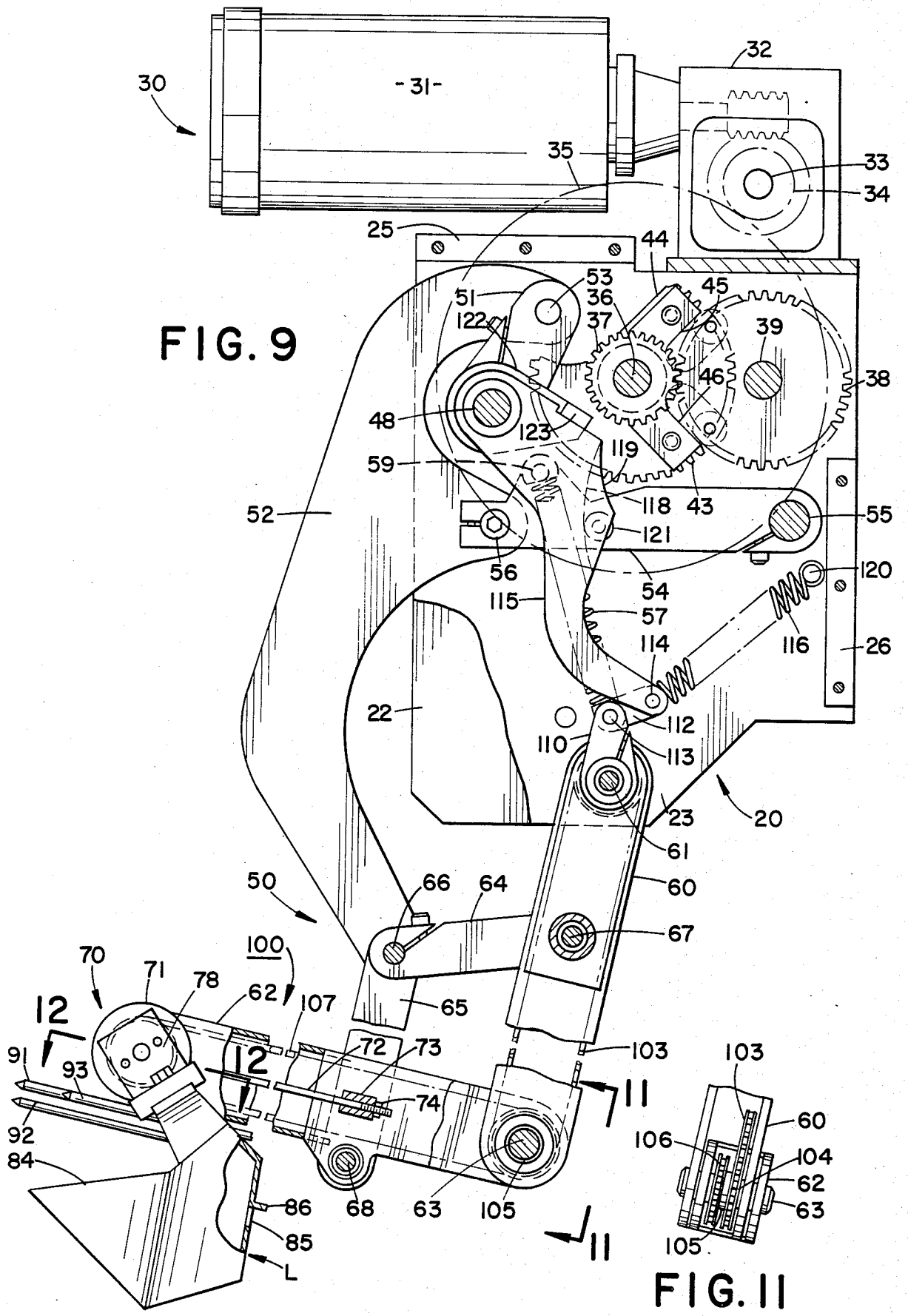
FIG. 9 is a broken elevational view on an enlarged scale, with parts broken away and shown in section for the purpose of illustration.
FIG. 11 is a fragmentary elevation, taken on the line 11—11 of FIG. 9.
Figure 10:
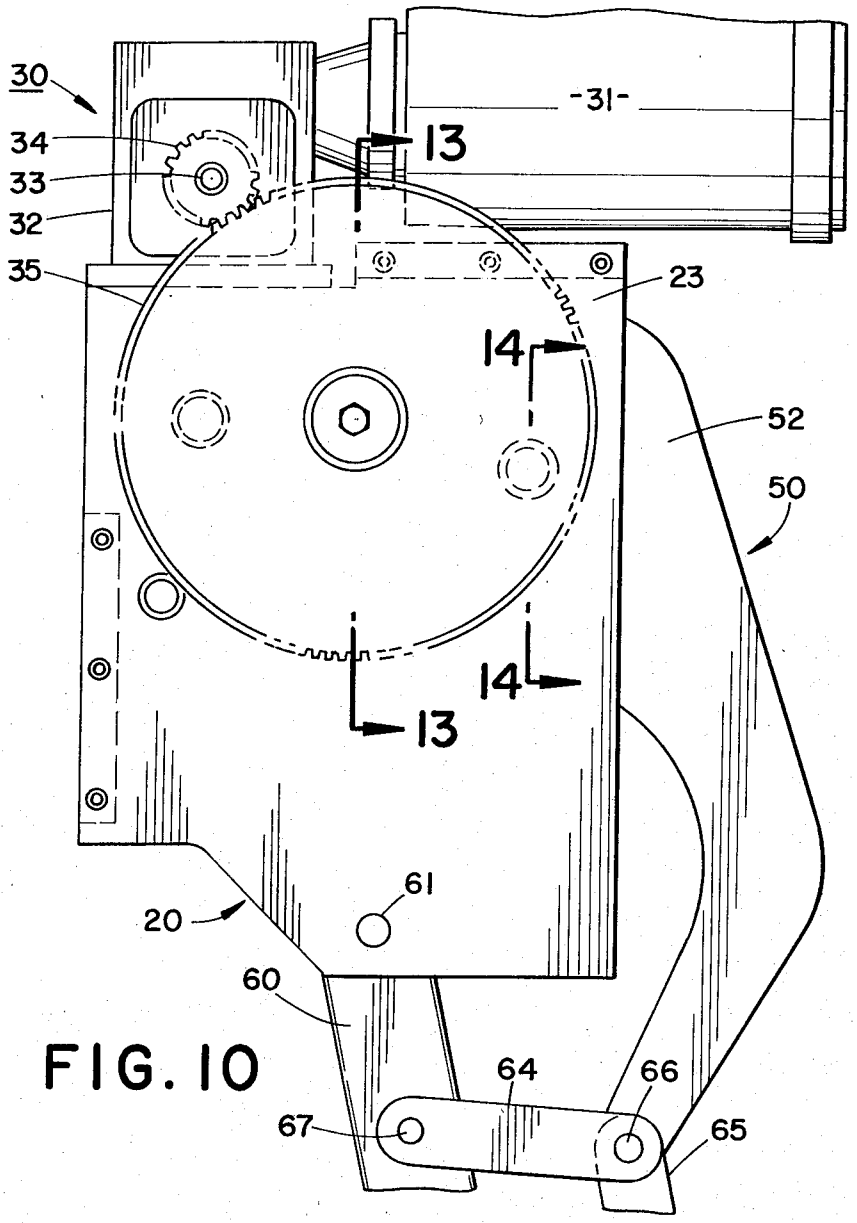
FIG. 10 is a fragmentary elevation, with parts broken away, taken on the line 10—10 of FIG. 8.

The drive assembly 30 includes a reversible DC motor 31 and an associated worm-type gear reduction unit 32 with an output shaft 33, as best illustrated in FIG. 8. The shaft 33 has a pinion 34 that meshes with a large input gear 35 keyed to a shaft 36 journaled in the side plates 22 and 23 (FIG. 9). Another pinion 37 is keyed to the shaft 36 between the plates 22 and 23 and meshes with a gear 38 that is keyed to a shaft 39 also journaled in the side plates 22 and 23.

The gear 38 carries a pair of laterally extending rollers 41 and 42 which form part of a Geneva motion mechanism that includes a Geneva gear segment 43 journaled on the shaft 36. The Geneva gear segment 43 has a recessed portion cut therein that receives a plate 44 that defines a pair of slots 45 and 46 arranged perpendicularly to one another (FIG. 9). The rollers 41 and 42 are received in the slots 45 and 46 to produce a Geneva type motion for the gear segment 43. The teeth of the gear segment 43 engage a pinion 47 keyed to a crankshaft 48 journaled at its ends in the side plates 22 and 23. The crankshaft 48 provides the drive for the ladle transport linkage which carries the ladle dipper L through its operating cycles.

Ladle Transport Assembly

The movement provided by the ladle transport assembly 50 is best illustrated in FIGS. 1 and 3 through 6, wherein it will be seen that the path of movement (shown in dashed lines in FIG. 1) includes a generally horizontal span that extends to a pour position adjacent the die casting machine at one end and a downwardly curved, generally vertical portion wherein the ladle dipper L is dipped into the furnace at the opposite end or the right hand end as viewed in FIG. 1.

The assembly 50 includes a crank arm 51 keyed to the crankshaft 48 and pivotally connected at its outer end to a generating arm 52 by a pivot pin 53. The shape of the generating arm is best shown in FIG. 9. The movement of the motion generating arm 52 is controlled by both the crank 51 and a rocking link 54 which is pivotally supported on a shaft 55 journaled between the plates 22 and 23, and which is also pivotally connected to the motion generating arm 52 by means of a pivot pin 56.

It will be noted that the motion produced at the outer end of the motion generating arm 52, resulting from the movement of the crank 51 and rocking lines 54 (see FIGS. 3 through 6), includes primarily horizontal and vertical components corresponding generally, but on a reduced scale, to the ladle movement illustrated in dashed lines in FIG. 1. In order to compensate for the variable loads that occur during operation of the linkage so far described, a helical counterbalance spring 57 is adapted to urge the rocking link 54 toward its upward position illustrated in FIG. 9. The counterbalance spring 57 is mounted on a rod that extends between a lower support stud 58 mounted on the sideplate 23 and a swivel pin 59 mounted on the rocking link 54.

The motion produced at the outer end of the motion generating arm 52 is transferred to another link assembly that includes a main link 60 pivotally connected to the main housing 20 by a pivot pin 61 and a carrier link 62 adapted to carry the ladle dipper L at its outer end and pivotally connected by a pivot pin 63 to the outer end of the main link 60. The main link 60 and carrier link 62 are each connected to the lower end of the generating arm 52 by a pair of control links 64 and 65, respectively, with one end of each connected to one another and to the other end of the motion generating arm 52 by a pivot pin 66.

The opposite end of the link 64 is connected to a central portion of the main link 60 by a pivot pin 67 and the opposite end of the link 65 is pivotally connected to the mid-portion of the carrier link 62 by a pivot pin 68. With this arrangement, it will be seen that the motion produced at the end of the generating arm 52 is magnified by the link assembly 60, 62, 64, and 65 to produce the path of travel generally shown by dashed lines in FIG. 1.

Figure 12:
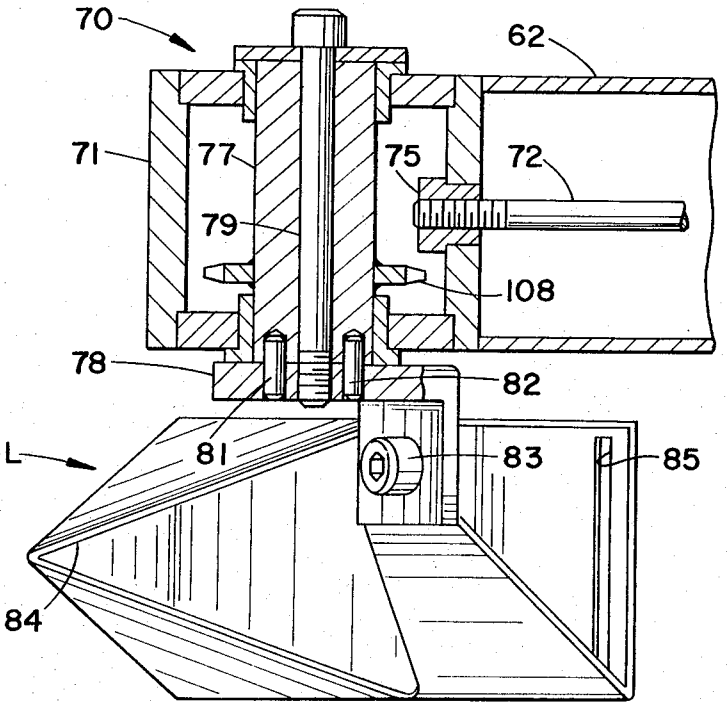
FIG. 12 is a fragmentary sectional view on an enlarged scale, taken on the line 12—12 of FIG. 9.
Figure 13:
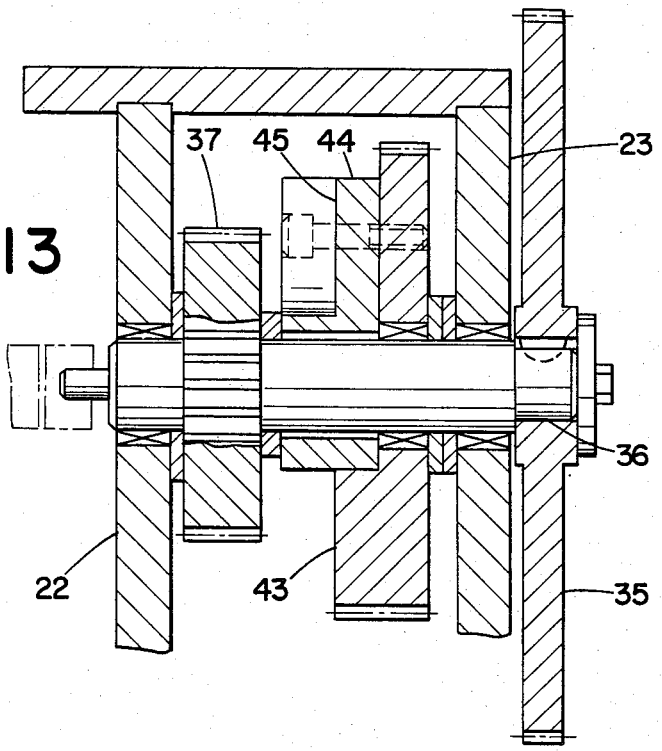
FIG. 13 is a fragmentary sectional view, taken on the line 13—13 of FIG. 10.

The ladle dipper L is supported at the outer end of the carrier link 62 by means of a ladle carriage assembly 70, best shown in FIGS. 9 and 12. The assembly includes a carrier housing 71 comprising sideplates and end plates pressed together to form an enclosure and adapted to be connected to the end of the carrier link 62 by means of a threaded rod 72. The inner end of the rod 72 is connected to a brace 73 centrally mounted in the carrier link 62 by means of a nut 74 (FIG. 9), and the outer end of the rod 72 is secured to the carrier housing 71 by means of a threaded insert 75. This arrangement permits the ladle dipper L and ladle carriage assembly 70 to be removed from the apparatus quickly and conveniently by disconnecting the inner end of the threaded rod 72 by removing the nut 74.

Journaled in the carrier housing 71 is a shaft 77 with a bracket 78 secured to one end by a bolt 79 that extends axially through the shaft 77. The bracket 78 is locked in place on the shaft by means of locater pins 81 and 82. The bracket 78 is of a generally L-shaped configuration and the ladle dipper L is mounted thereto at the base of the "L" by means of a nut 83.

The ladle dipper L is of generally conventional design, and includes a pour spout 84 at one end and a fill slot 85 at the opposite side with a lip 86 extending outwardly along the upper part of the slot.

The carrier link 62 has a bracket 90 secured thereto adapted to carry three metal level sensing probes 91, 92, and 93 (FIGS. 1 and 9) forming part of the control system for the apparatus, to be described in detail below. The probes are lowered into the furnace coincidentally with the lowering of the ladle dipper L into the furnace to obtain a charge of molten metal. The probes 91 and 92 each comprise electrical conductors capable of conducting low current and as they contact molten metal, an electrical connection is made between them. Accordingly, when they first reach the level of molten metal in the furnace 21, they provide an electrical signal that is used to halt the downward movement of the ladle dipper L in an appropriate position to begin drawing molten metal from the furnace. The probe 93 is much shorter and is used to sense a "high metal level" condition in the furnace.

Ladle Tilt Assembly

In order to control the ladle dipper attitude during transporting of molten metal, i.e., to maintain the ladle dipper in a level condition and also to tilt the ladle dipper slightly backwardly during the fill operation and forwardly during the pour operation, a ladle tilt assembly 100 is provided generally in association with the main link 60 and the carrier link 62. The ladle tilt assembly 100 includes a sprocket 101 (FIG. 8) secured to a sleeve 102 that is pivotally received around the pin 61. The sprocket 101 drives an endless roller chain 103 that extends from one end to the other of the main link 60 and drives another sprocket 104 secured to a sleeve 105 that is freely received over the pin 63 (FIGS. 9 and 11).

Another sprocket 106 is secured to the sleeve 105 coaxially with the sprocket 104, and is adapted to drive another endless roller chain 107 which extends the length of the carrier link 62 to another sprocket 108 (FIG. 12) secured to the shaft 77 of the ladle carriage assembly 70.

Thus, it will be seen that the tilting movement by the ladle dipper L is controlled by rotation of the sprocket 101 and sleeve 102. Such control is important during the movement of the ladle dipper between its fill and pour positions because of the varying changes in attitude of the carrier link 62, which moves between a generally vertical position shown in dashed lines in FIG. 1 and in solid lines in FIG. 4, and a generally horizontal position shown in solid lines in FIGS. 1, 5, and 6.

It will be noted, however, that if the position of the sprocket 101 (and thus sleeve 102) is held fixed during the movement of the main link 60 and carrier link 62, then the ladle dipper attitude will remain constant regardless of the angular position of the carrier link 62. On the other hand, any movement of the sprocket 101 will result in forward or backward tilting of the ladle dipper L.

Figure 7:
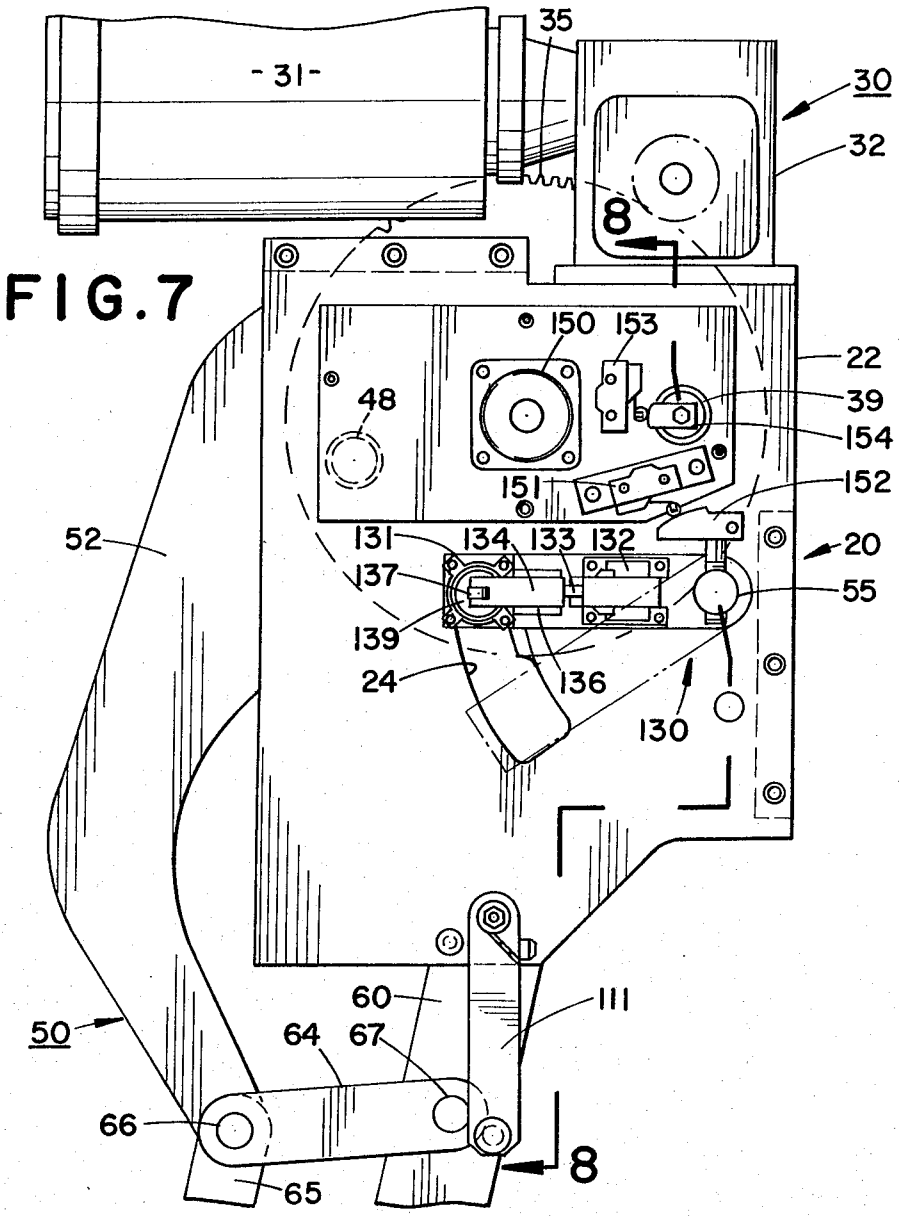
FIG. 7 is a fragmentary side elevation on an enlarged scale of the apparatus of FIG. 1.

To control the ladle dipper tilt angle, a crank arm 110 is also connected to the sleeve 102 for use in association with certain control linkage, the operation of which is coordinated with the movement of the ladle transport assembly 50. In order to control the ladle tilt position manually, however, a manual crank 111 is mounted on the outer end of the sleeve 102, as best shown in FIG. 7.

Figure 14:
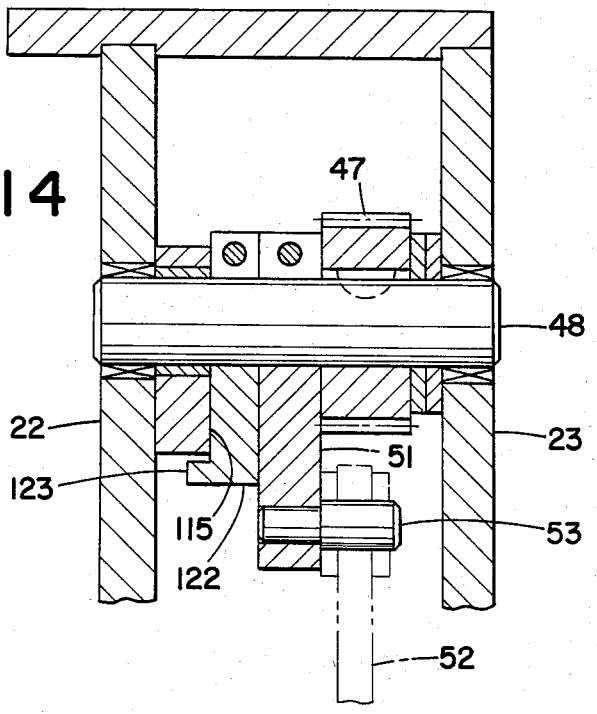
FIG. 14 is a fragmentary sectional view, taken on the line 14—14 of FIG. 10.
Figure 17:
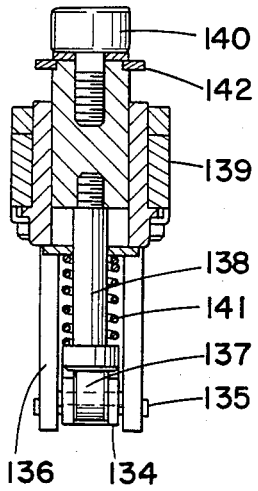
FIG. 17 is a fragmentary sectional view, taken on the line 17—17 of FIG. 16.

A lazy link 112 is connected by a pin 113 to the end of the crank arm 110, and by a pin 114 at its other end to an end of a cam link 115, which is freely pivoted on the shaft 48 (FIGS. 9 and 14). The lower end of the cam link 115 is urged in a counterclockwise direction, or to the right as viewed in FIG. 9, by a helical spring 116 which is connected between the pivot pin 114 and a mount 120 on the sideplate 22. The counterclockwise movement of the cam link 115, and thus of the crank arm 110, is prevented, however, by a cam roller 121 mounted at the mid-portion of the rocking line 54. The cam roller 121 engages a cam surface 118 (dashed lines in FIG. 9) that is cut only through a portion of the thickness of the link 115 on the side opposite that viewed in FIG. 9. The cam surface 118 is curved, with its radius of curvature centered at the axis of the pin 55 so that as long as the roller 121 engages the curved cam surface 118, there is essentially no movement of the cam link 115, and thus no movement of the sprocket 101 can occur.

Figure 3:
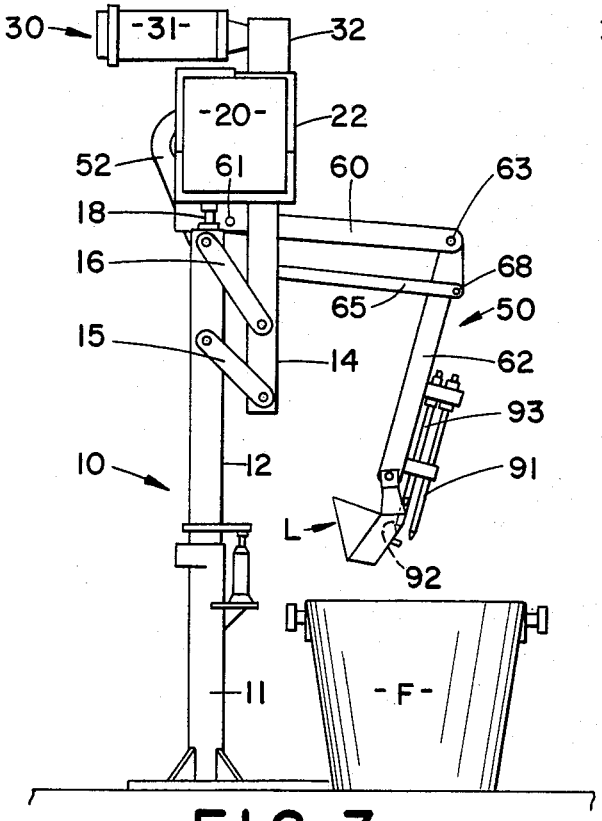
FIGS. 3 through 6 are diagrammatic views illustrating various positions of the apparatus during a ladling cycle.
Figure 4:
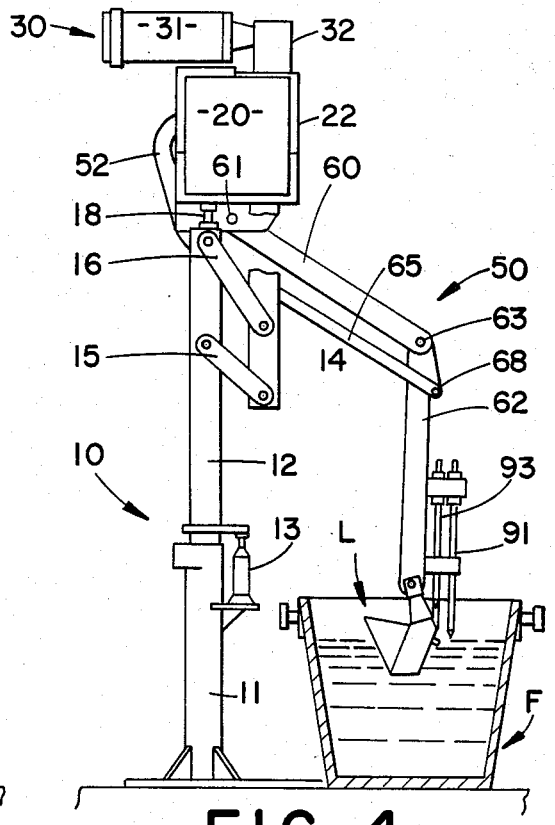

It will be noted, however, that as the generating arm 52 moves toward the position shown in FIGS. 3 and 4, the rocking link 54 will pivot downwardly about the shaft 55 until the roller 121 travels below the curved cam portion 118. As this occurs, the cam link 115 pivots counterclockwise about the shaft 48 in reponse to the urging of the spring 116 to cause clockwise pivoting of the crank arm 110. This results in a rearward tilting of the ladle dipper L, as illustrated in FIG. 4, to facilitate filling of the ladle dipper with molten metal from the furnace through the fill slot 85. As the carrier arm 62 lifts the ladle dipper L out of the furnace, however, the motion of the generating arm 52 pivots the rocking link 54 in a clockwise direction until the cam roller 121 again engages the arcuate cam surface portion 118 to tilt the ladle dipper back to its transport position.

In order to tilt the ladle dipper forwardly for pouring, it will be noted that the cam link 115 must be pivoted about the shaft 48 in a clockwise direction to turn the sprocket 101 in a counterclockwise direction. This movement is provided by means of a dog carrier arm 122 secured to the shaft 48 for rotation with the crank arm 51. The carrier arm 122 has a dog 123 at its outer end that is adapted to rotate to a position shown in FIG. 9, wherein it engages the cam link 115 and pivots it against the tension force of the spring 116 in a clockwise direction. This engagement occurs at the outer limits of the horizontal travel of the ladle dipper L or, in other words, as the ladle dipper approaches the die casting machine. Accordingly, the dog 123 produces a progressive tilting of the ladle dipper simultaneously with the continued advance thereof so that the pour spout 84 of the ladle remains in approximately the same vertical line, even though the forward motion of the carrier arm 62 continues slowly. Then, as the motor 31 reverses to drive the crank arm 51 in a counterclockwise direction, the dog 123 also reverses and moves in a counterclockwise direction until the cam link 115 pivots back into engagement with the cam roller 121.

"Not-Ready-To-Pour" Abort System

At times during the automatic operation of the ladling apparatus, it may be desirable to halt the forward movement of the ladle transport assembly 50 and return the molten metal-filled ladle dipper back to the furnace to be dumped. In order to provide for this abort cycle, there is provide a special mechanism 130 by which the molten metal can be dumped back into the furnace using the ladle tilt assembly 100. The components of this mechanism are best shown in FIGS. 7, 15, 16, and 17.

The mechanism 130 includes a carrier arm 131 which is attached to the same shaft 55 on which the rocking link 54 is pivoted. The arm 131 is located on the outside of the sideplate 22, and it extends radially, parallel to the rocking link 54, the outer end of the arm 131 being positioned adjacent the curved slot 24 in the sideplate 22. The mechanism includes a solenoid 132 mounted on the arm 131 and having a plunger 133 that is pivotally connected to a bell crank 134, which in turn is pivotally mounted by a pin 135 in a bifurcated bracket 136 secured to the arm 131. The opposite end of the bell crank 134 has a roller 137 adapted to engage the outer end of a plunger 138 which extends slidably through a bearing assembly 139, and also into the slot 24. The plunger 138 is urged to a retracted position by a helical return spring 141. Another cam roller 140 is mounted on the end of the plunger 138, and is adapted to be moved thereby into an extended operating position.

When the solenoid 132 is energized, the bell crank 134 pivots about the pin 135, compressing the plunger 138 against the force of the spring 141. This moves the cam roller 140 inwardly (FIGS. 16 and 17) to a position wherein it is adapted to engage the abort cam surface 119 (FIG. 9) out of the cam link 115.

Figure 15:
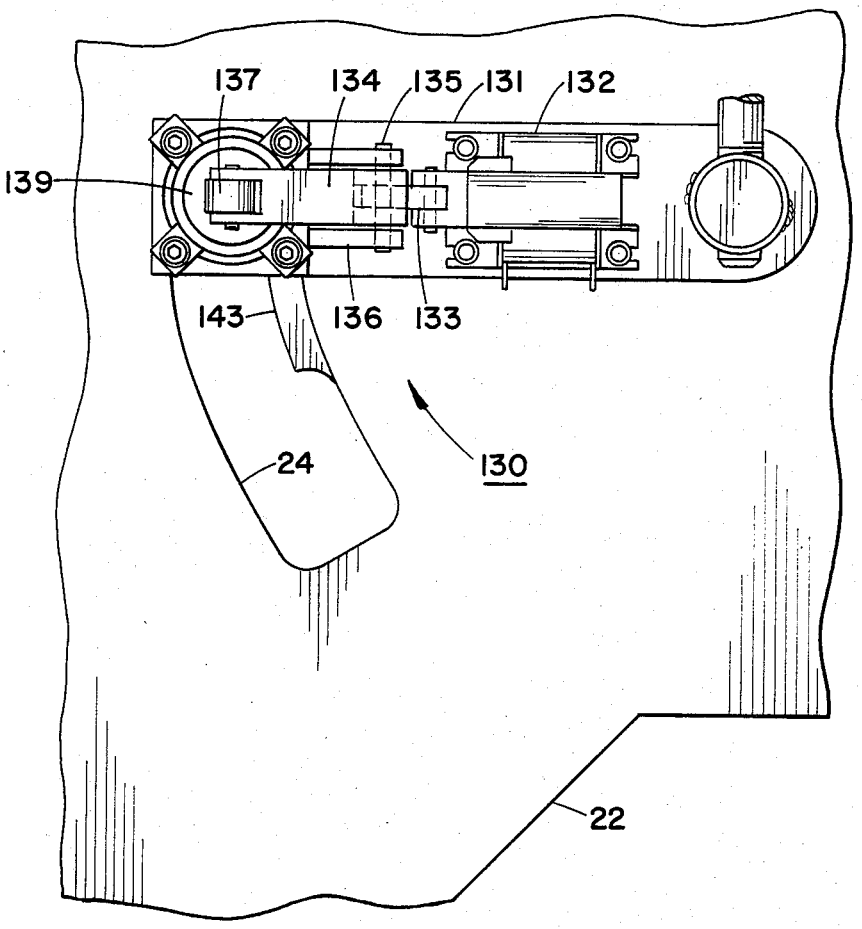
FIG. 15 is a fragmentary, elevational view illustrating the low metal level abort mechanism embodied in the invention.

The solenoid 132 is generally energized when the carrier arm 131 is pivoted in a clockwise direction from the position shown in solid lines in FIGS. 9 and 15 to a position shown in dashed lines in FIG. 7 wherein the cam link 115 is pivoted counterclockwise to a limit position. Then, when the carrier arm 131 pivots back in a clockwise direction with the shaft 55, the roller 140 engages the cam surface 119 and causes the cam link 115 to pivot in a direction causing forward tilting (i.e., to a dumping position) of the ladle dipper L. This is accomplished when the ladle dipper is above the furnace F and causes the ladle dipper to pour molten metal contained therein back into the furnace.

Figure 16:
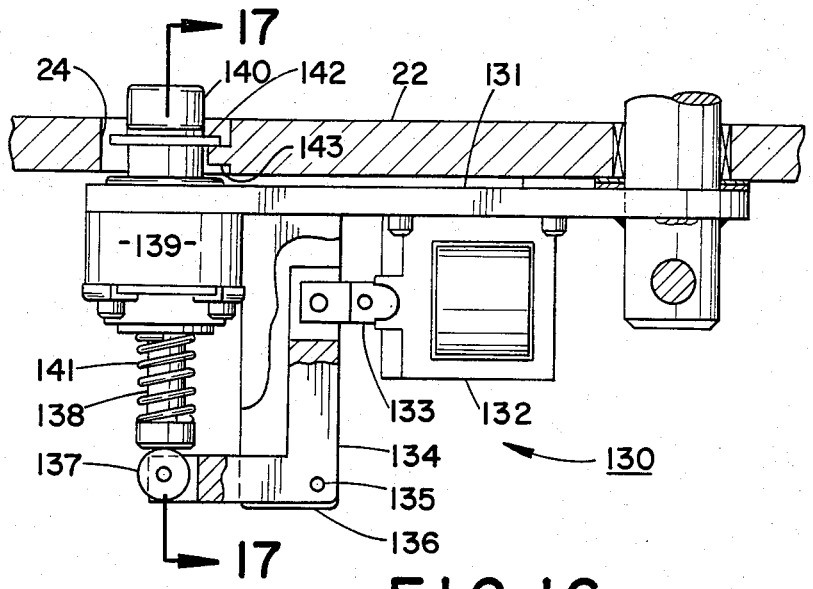
FIG. 16 is a fragmentary sectional view, taken on the line 16—16 of FIG. 15.

A locking ring 142 is mounted on the plunger 138 at its forward end adjacent the cam roller 140 in order to positively lock the roller 140 in its extended position once it engages the cam surface 119. When the plunger 138 and roller 140 are extended, the arm 131 is in approximately the position shown in dashed lines in FIG. 7. Then as the arm 131 swings upwardly in a clockwise direction, the locking ring 142 slides behind a curved ledge 143 that extends into the curved slot 24. The ledge 143 is best shown in FIGS. 7 and 16. Thus, the ledge blocks rearward movement of the ring 142 and prevents retraction of the plunger until the carrier arm swings back to the position shown in dashed lines in FIG. 7. In that position, the ladle dipper L would be over the furnace F.

Operation

The operation of the apparatus is generally controlled by components that include an encoder 150 operatively connected to the shaft 36, a limit switch 151 operated by a cam 152 carried on a pin 153 that extends radially through the outer end of the shaft 55, and a limit switch 156 operated by a cam 157 carried on the outer end of the shaft 39. The location of these components is best shown in FIG. 7. The limit switch 151 is actuated whenever the ladle dipper reaches a lower limit position in the furnace without having the probes 91 and 92 contact the molten metal. The switch 156 is actuated when the ladle dipper approaches its pouring position to start a timer that initiates a "not-ready-to-pour" abort sequence whenever certain ready-to-pour signals are not received from the die casting machine D.

The automatic operating cycle of the apparatus is actuated by operating the motor 31 from a condition wherein the ladle dipper is located at an intermediate rest position. The motor 31 operates in its reverse direction at a predetermined speed through the Geneva motion mechanism to turn the crank 51 in a counterclockwise direction so that the ladle transport assembly 50 retracts the ladle dipper L rearwardly and then in a downwardly curved path (FIG. 3) into the furnace F. The ladle dipper L will halt its downward movement when a metal level signal is sensed by the probes 91 and 92. At this point, a timer is actuated for an interval in which the DC motor 31 is halted to permit the ladle dipper L to fill with molten metal (FIG. 4). If the level of the molten metal rises enough to touch the third probe 93, the ladle dipper will be raised until all of the probes are out of the metal. Then, the motor will be operated again to lower the ladle dipper until the probes touch and the dipper-fill timer will be actuated again.

After the dipper-fill timer times out, the motor 31 is operated in its forward direction and the ladle dipper L is raised to a spill-off position determined by a preset pulse count in the encoder 150 and held there until a spill-off timer times out. This permits excess molten metal to drop off back into the furnace.

When the timer times out, the motor 31 is operated in its forward direction again and the ladle dipper L is moved forward (FIG. 5) to the die casting machine D. At this time, the limit switch 156 is actuated by the cam 157 and the ladle dipper moves forward (FIG. 6) at a predetermined ready-to-pour speed. Normally, the control system will receive a signal from the die casting machine indicating that the dies are locked in a closed position and the injection plunger is retracted. If these signals are not received, the ladle dipper will stop and a "not-ready-to-pour" abort timer will start timing out. If the abort timer times out before the die-locked and plunger-retracted signals are received, the unit will go into a "pour-signal-not-received" abort sequence. If the die-locked plunger retract signals are broken while the ladle is pouring, the ladle dipper will stop and the abort timer will start timing again.

Once the ladle dipper is pouring (FIG. 6), it will start moving forward at the first pour speed to the first pour position. Once it reaches the second pour position, it will change into the second pour speed and continue forward. Once it reaches the third pour position, it will change into the third pour speed and continue forward. The ladle will continue forward until the final pour position is reached, and at this time the unit will start retracting at the return-to-rest speed.

If the pour-signal-not-received abort timer times out, the respective abort cycle will begin. The ladle dipper L will start retracting at a predetermined speed until it is returned to the furnace the probes touch the molten metal. At approximately this time, the dump solenoid 132 will be energized and the ladle will start forward. The forward movement causes engagement between the cam roller 140 and the cam surface 119 of the cam link 115 to cause the dipper to tilt and pour the molten metal contained therein back into the furnace. When this is done, the dipper will be moved back to the rest position to await the next cycle-start signal.

Control System

With reference to FIG. 7, the basic components of the control system for the apparatus A include an encoder 150 on the shaft 36, a limit switch 151 operated by a cam 152 carried on a pin 153 that extends radially through the shaft 55, and a limit switch 156 operated by a cam 157 carried on the outer end of the shaft 39. The limit switch 151 is actuated whenever the ladle dipper reaches a lower limit position in the furnace. The limit switch 156 is actuated when the ladle dipper approaches its pouring position.

Figure 18:
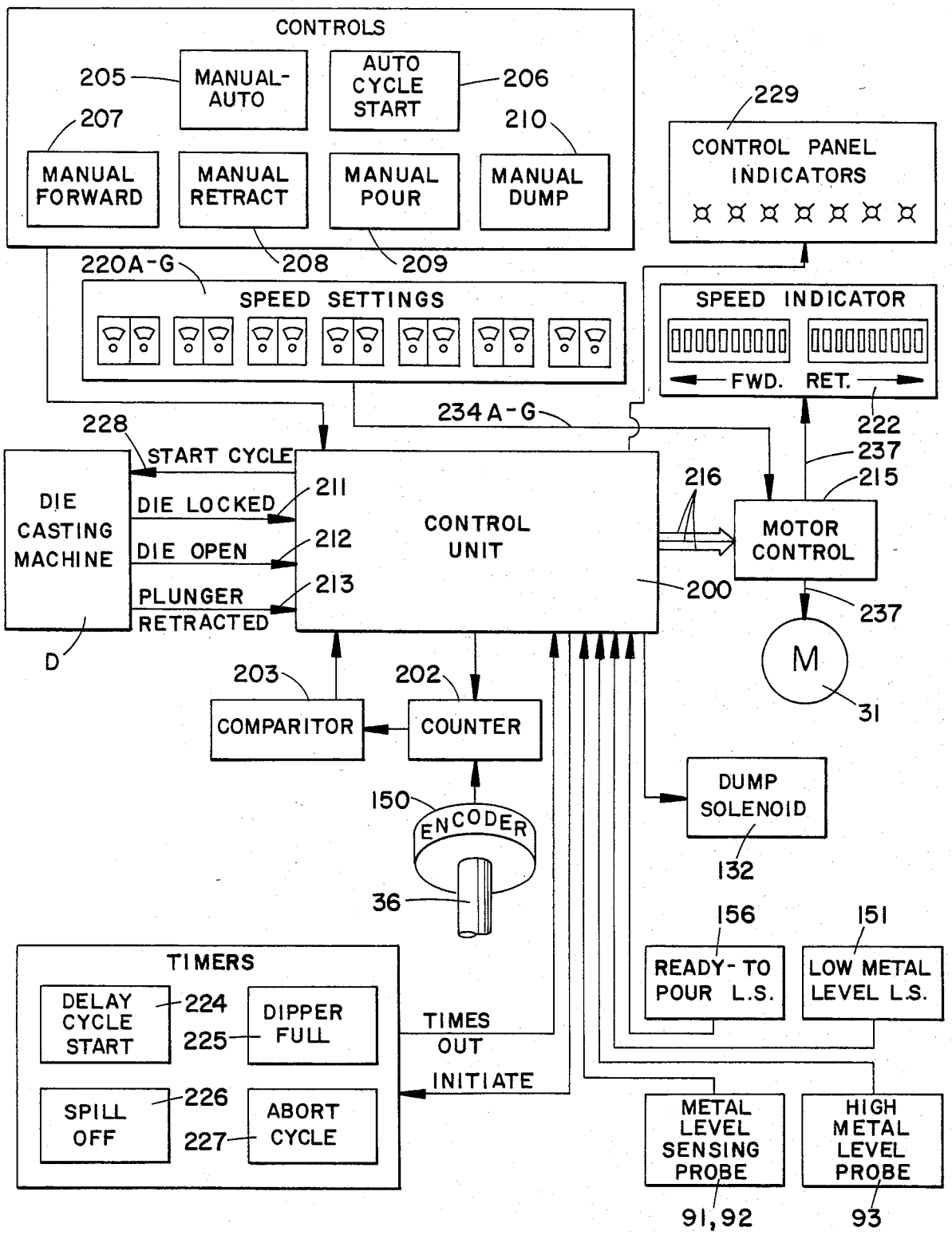
FIG. 18 is a schematic block diagram of a control system of the invention.

As shown in FIG. 18, the limit switches 151 and 156, along with the metal level sensing probes 91, 92, and 93, are connected to a control unit 200 which controls the operation of the apparatus A. The control unit 200 is also connected to the encoder 150 through a counter 202 and a comparator 203. The control unit 200 operates in accordance with input control signals supplied from control switches 205–210. The control unit 200 also receives interlock signals from the die casting machine D on lines 211–213. In accordance with these input signals, the control unit operates the apparatus A by controlling the operation of the motor 31 through a motor control circuit 215.

The control unit 200 is connected to the motor control circuit 215 by means of a three-bit line 216 which supplies the circuit 215 with data indicating at which of eight pre-adjusted speeds the motor 31 should be operated. In accordance with the signal on the line 216, the circuit 215 selects one of the eight motor speeds which are preset by the speed control settings 220A-G. The selected speed is also fed to a speed indicator display 222. The three-bit line 216 is capable of providing a signal designating one of eight different speed indications to the motor control circuit 215. These eight speed signals are represented in the following table:

TABLE 1

| Three-Bit Signal (Line 216) | Speed | Description | Direction |
|---|---|---|---|
| 000 | Stop | No movement | — |
| 001 | A | Retract-to-Metal Speed | Retract |
| 010 | B | Dipper-Fill Speed | Forward |
| 011 | C | Forward-to-Pour Speed | Forward |
| 100 | D | First Pour Speed | Forward |
| 101 | E | Second Pour Speed | Forward |

TABLE 1-continued

| Three-Bit Signal (Line 216) | Speed | Description | Direction |
|---|---|---|---|
| 110 | F | Third Pour Speed | Forward |
| 111 | G | Retract-to-Rest Speed | Retract |

The control unit 200 monitors the position of the ladle transport assembly and receives signals indicating that the transport assembly is at one of various programmable positions. These positions are determined using the encoder 150, the counter 202, and the comparator 203. As each position is desired, a binary number which is stored in the control unit 200 is fed into the counter 202. The counter 202 then counts down to zero as it is pulsed by the encoder 150 as the shaft 36 rotates. The output of the counter 202 is fed to the comparator 203 which compares the counter output to zero. When the output of the counter 202 is equal to zero, the comparator 203 sends a signal to the control unit 200, indicating that the desired position has been reached.

In the preferred form of the present invention, there are six positions which are determined by the encoder 150. These positions are all programmable, and a determination of the location of each position depends upon the count provided to the counter 202. In the preferred form of the present invention, the six positions are:

(a) A spill-off position. This is the position at which the ladle dipper begins spill-off at the furnace F after it has been filled, and at which a spill-off timer is initiated. The count fed to the counter 202 represents the distance from the metal level to the position above the metal level in which spill-off occurs.

(b) Pour position No. 1. This is the position at which the ladle transport assembly switches from the first pour speed to the second pour speed. The count fed to the counter 202 represents the distance from the ready-to-pour position at which the limit switch 156 is made to the position in which pouring begins at the first pour speed.

(c) Pour position No. 2. This is the position at which the ladle transport assembly switches from the second pour speed to the third pour speed. The count fed to the counter 202 represents the distance from the pour position No. 1.

(d) Pour position No. 3. This is the position at which the ladle transport assembly finishes pouring. The count fed to the counter 202 represents the distance from the pour position No. 2. This position is the full forward position of the ladle transport assembly.

(e) Rest position. This is the position of the ladle transport assembly at the end of the cycle. The count fed to the counter 202 represents the distance from the full forward position, or pour position No. 3, to the rest position in which the apparatus will stop when it is not in cycle.

(f) Abort-rest position. This position should be the same as position (e). The count fed to the counter 202 represents the distance from the metal level to the desired rest position.

During the operation of the apparatus A, certain steps are delayed, and therefore the control unit 200 is connected to a plurality of adjustable timers 224–227. A delay-cycle-start timer 224 delays the beginning of the automatic cycle after the auto cycle start switch 206 is actuated. A dipper-fill time timer 225 halts motion of the ladle dipper in the furnace so that the dipper may fill. A spill-off timer 226 delays motion of the dipper after it fills and while it is over the furnace F so that excess metal may spill off back into the furnace. And a cycle-abort timer 227 is used to delay the initiation of the abort cycle to give the die casting machine D adequate time to be prepared for the introduction of the metal. Each of these timers 224–227 is adjustable, so that each of the delay times may be varied.

The control unit 200 is also capable of initiating operation of the die casting machine D by sending an appropriate signal on a line 228. The control unit 200 is also connected to the dump solenoid 132 so that the ladle dipper L may be tilted during the abort sequence to dump metal back into the furnace F. Operation of the apparatus A is monitored by various control panel indicators 229, which are also operated by the control unit 200.

The control unit 200 may comprise any suitable control circuitry capable of carrying out a predetermined program of operation in accordance with various conditional inputs. In one form of the present invention, the control unit 200 comprises a circuit of TTL components in which the signal for each step of the operations is conditional upon the completion of a previous step. Such a control unit has the advantage in that an easy step-by-step movement can be obtained for ease of understanding and troubleshooting. In addition, a stepwise control system provides for noise immunity. This is achieved by making the enable for a step come from the output of the preceding step. If there is noise on an input to a step, that step will not be initiated unless the preceding step has already been accomplished.

Alternatively, the control unit 200 may comprise a microprocessor or other unit capable of performing a sequence of operation from a predetermined program. For example, the program may be contained in a read-only memory which drives a multiplexer unit to provide the necessary signals.

The control switches 205–210 include a manual-auto selector switch through which the operator selects between manual and automatic operation of the apparatus A. If automatic operation is selected, the operator initiates the operation by actuating the auto-cycle-start switch 206. If manual operation is selected, the operator controls the movement of the ladle transport assembly using the manual control switches 207–210. The manual forward switch 207 moves the ladle transport assembly forward, and the manual retract switch 208 moves the transport assembly back. The manual pour switch 209 is used to cause the ladle transport assembly to move forward and pour the metal into the die casting machine D when the transport assembly is past the ready-to-pour position. The manual dump switch 210 is used to actuate the solenoid 132 to dump metal from the dipper back into the furnace when the ladle dipper is over the furnace.

Figure 20:
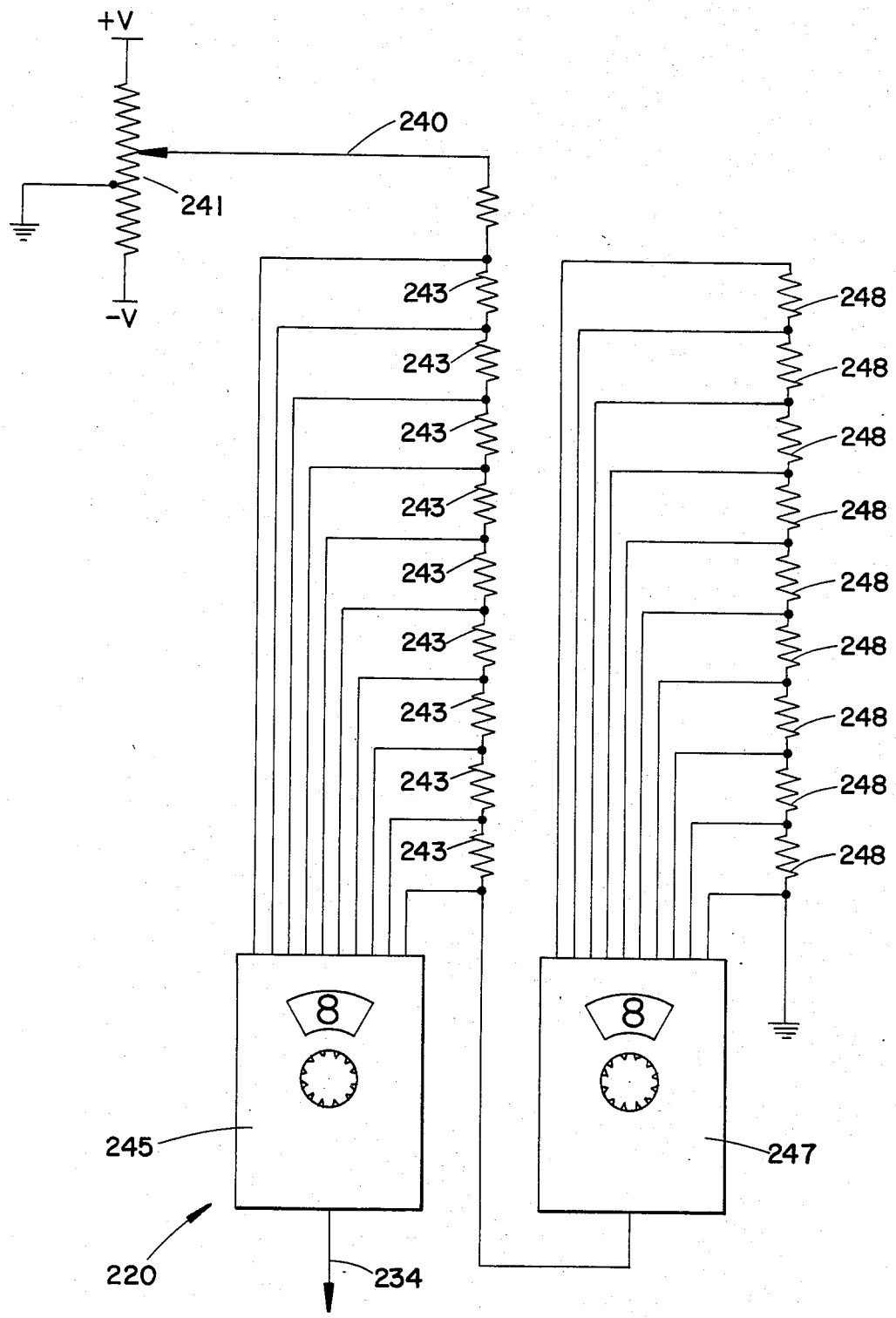
FIG. 20 is a schematic diagram of a portion of FIGS. 18 and 19 showing speed control settings.

The details of the motor control circuit 215 may be seen with reference to FIGS. 19 and 20. As shown in FIG. 19, the three-bit line 216 from the control unit 200 is fed to a binary-to-decimal decoder 231. The b/d decoder 231 may be, for example, an SN7445 integrated circuit unit manufactured by Texas Instruments, Inc., which is a TTL circuit, and is thus compatible with the TTL logic employed in the control unit 200. The b/d decoder 231 provides eight outputs which are used as control inputs for an array of analog switches 233. The array of analog switches 233 selectively connects either ground or one of the motor speed control settings 220A-G supplied on lines 234A-G to line 235. The array of analog switches 233 may be, for example, a pair of AD7501 multiple analog switch units manufactured by Analog Devices. The line 235 is connected to the positive input of a unity-gain voltage follower amplifier 236 having a feedback loop in which the output is connected to the negative input of the amplifier. The output of the amplifier 237 is fed to the motor 31 on line 237.

Each of the motor speed settings 220A-G is identical, and a typical motor speed setting 220 is shown in greater detail in FIG. 20. Each control 220 has a reference voltage which is supplied on a line 240. The line 240 is connected to the output of a potentiometer 241 which is connected between either positive or negative supply voltages. By adjusting the potentiometer 241, a maximum speed adjustment may be obtained for each individual speed. The potentiometer 241 is capable of adjustment between either the positive supply voltage or the negative supply voltage and zero, typically between +15 volts and −15 volts. The line 240 which supplies the reference voltage is fed to a cascade of nine identical resistors 243 connected in series. The intermediate points between the series-connected resistors 243 are connected to a rotary switch unit 245, which selects one of the points in the cascade for connection to the output line 234 which is connected to the analog switch 233. The bottom of the cascade of resistors 243 is connected to the output of an identical rotary switch unit 247. The rotary switch unit 247 is connected to intermediate points between a cascade of nine identical resistors 248 connected in series. The bottom of the cascade of resistors 248 is grounded. The values of the resistors 243 and 248 are selected such that each of the resistors 243 is identical and each of the resistors 248 is identical, and the value of each of the resistors 243 is ten times the value of each of the resistors 248. The switch units 245 and 247 thus provide a two-digit decimal-type control in which any of 99 different voltage outputs may be provided on the line 234 from a given reference voltage supplied on the line 240. The switch unit 245 provides the "tens" of the setting and the switch unit 241 provides the "ones" of the setting. In addition, the potentiometer 241 provides for adjustment of the reference voltage on the line 240, so that the speed is infinitely variable between the positive or negative supply voltages and zero. Once the reference voltage has been selected by the potentiometer 241, any of 99 different incremental voltages may be selected using the switches 245 and 247.

There are seven speed control settings 220A-G, each of which is identical to the speed control setting 220 disclosed in FIG. 20, so that seven independent speed settings may be provided.

The motor 31 runs from the power supply connected to the potentiometer 241 for each of the speed control settings 220A-G. This power supply is typically +15 volts and −15 volts. The amplifier 136 also runs from this power supply. The other portions of the control unit are preferably TTL or TTL-compatible, and run from a +5-volt power supply. This +5-volt power supply is preferably optically isolated from the 15-volt power supply which runs the motor 31 so that any interference produced by the motor will not affect the other components of the control system.

The output of the amplifier 236 is also fed on the line 237 to the speed indicator display 222 shown in FIG. 19. The output on the line 237 is fed through a resistor 251 to a bar graph display driver 252. The display driver 242 is connected to a display 253 comprising an array of LED bars. The display 253 may be, for example, an MV57164 unit manufactured by General Instruments, which comprises a ten-bar LED display. The display driver 252 may be, for example, an LM3914 integrated circuit unit manufactured by National Semiconductors, which supplies ten outputs to the display 253. The LM3914 unit provides a linear display whereby one of the ten LED's is illuminated for each tenth of full-scale voltage fed to the display driver. Alternatively, the display driver 252 may be an LM3915 unit, also manufactured by National Semiconductors, which provides for a logarithmic display in the bar graph display 253 instead of a linear display. The input of the display driver 252 is grounded through a capacitor 254 to delay the rise and fall of the display and is grounded through a biasing diode 255 to prevent negative voltage levels from being fed to the display driver 252. The display driver 252 is connected to a calibration potentiometer 257 which provides a reference voltage to the display drivers at which a full scale indication will be displayed.

The display 253 only operates when the voltage on the line 237 is positive. A substantially identical circuit is provided for displaying negative voltage levels on the line 237. This display is fed by the output of a unity gain inverting amplifier 258. The amplifier 258 has the positive input grounded and the negative input connected to a feedback loop having a feedback resistor 259. An input resistor 260 is connected between the line 237 and the negative input of the amplifier 258. The resistors 259 and 260 are equal in value so that the amplifier 258 has a gain of one. The output of the amplifier 258 is fed through a resistor 261 to a display driver 262. The resistor 261 is identical to the resistor 250, and the display driver 262 is identical to the display driver 252. The display driver 262 operates a bar display 263 which is essentially identical to the display 253, but which is mounted in the opposite direction. The input of the display driver 262 has a capacitor 264 and a diode 265 which are identical in operation to the capacitor 254 and the diode 255.

Manual Operation

The apparatus A may be operated in either a manual mode or an automatic mode. In the manual mode of operation, the manual-auto select switch 205 is set to "manual" and the control unit 200 operates in accordance with this setting. To begin manual operation, the first step is to fill the dipper L. The operator depresses the manual retract switch 208. In response to the actuation of this switch 208, the control unit 200 supplies a signal on the lines 216 indicating the selection of the retract-to-metal speed A. The ladle transport assembly 50 will retract until the sensing probes 91 and 92 touch the metal in the furnace F, or until the low-metal-level limit switch 151 is made. Either one of these signals will stop the transport assembly from retracting. The control unit 200 stops retraction by sending a 000 signal on line 216 indicating no movement.

Once the dipper has had sufficient time to fill, the operator actuates the manual forward switch 207. The control unit 200 supplies a signal on the line 216 indicating the dipper-fill speed B, and the ladle transport assembly moves forward until it reaches the ready-to-pour position. This position is indicated by actuation of the limit switch 156. When the ladle transport assembly reaches the ready-to-pour position, the control unit 200 stops further movement.

To pour the metal in the die casting machine D from the ladle dipper, the operator actuates the manual pour switch 209, while at the same time actuating the manual forward switch 207. The control unit 200 checks to see that the dies are closed and locked and that the plunger is retracted on the die casting machine D. These signals are provided from the die casting machine D to the control unit 200 on the lines 211, 212, and 213. The control unit 200 will then send a signal on the line 216 to cause the motor 31 to operate at the first pour speed D until the ladle transport assembly reaches the first pour position. The first pour position is a programmable position and is determined by the signal received from the encoder 150 through the counter 202 and the comparator 203. After the ladle transport assembly reaches the first pour position, the control unit automatically switches to the second pour speed E by providing the appropriate signal on the line 216. The ladle transport assembly will go forward at this speed until it reaches the second pour position, as indicated by the encoder 150. At this time, the control unit 200 automatically changes the speed to the third pour speed F, and the ladle transport assembly will continue forward until it reaches the third pour position, at which time the control unit will cause it to stop moving forward.

The operator can return the ladle dipper L to the furnace F by actuating the manual retract switch 208. In response to the actuation of this switch, the control unit 200 will supply a signal on the line 216 indicating the retract-to-metal speed A and the ladle transport assembly will retract.

If during manual operation of the apparatus A it becomes necessary to dump metal back into the furnace, the operator can actuate the manual retract switch 208 to return the ladle dipper L to the furnace at the retract-to-metal speed A. Movement of the ladle transport assembly will be halted when the probes 91, 92 detect the presence of metal or when the low metal limit switch 151 is made. The operator then actuates the manual dump switch 210 to energize the dump solenoid 132 and cause the ladle dipper L to tilt. By actuating the manual forward switch 207, the operator causes the dipper L to move up and out of the metal in the furnace and the metal in the dipper is dumped back into the furnace.

Automatic Operation

Figure 21:
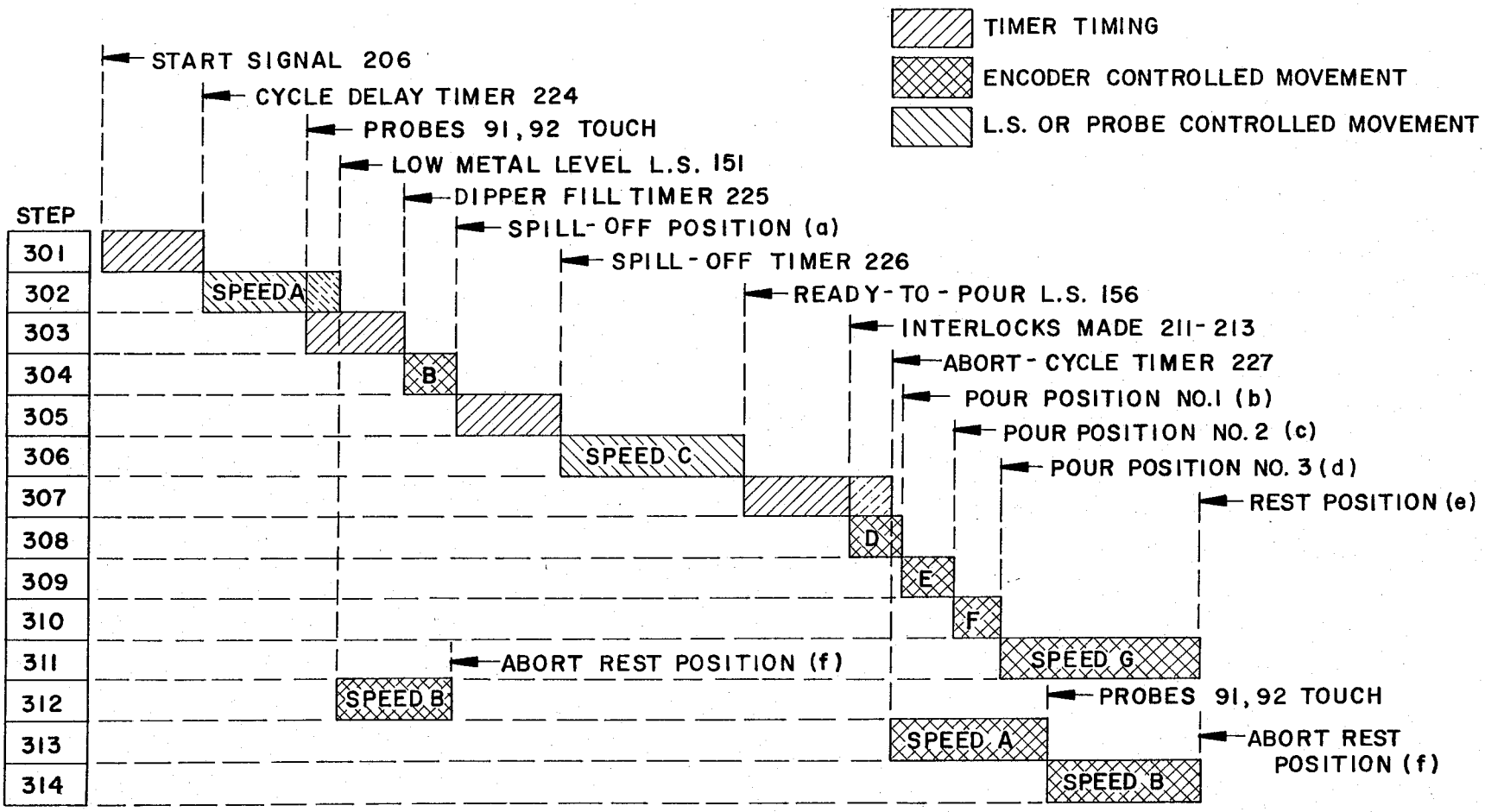
FIG. 21 is a timing chart illustrating the sequence of operation of the control system.

In addition to the manual operating mode, the control unit 200 also provides a completely automatic operating mode in which manual control at each step of the operation is not required, and in which the unit automatically aborts its sequence of operations under certain circumstances. To select the automatic mode of operation, the manual-auto switch 205 is positioned in the "auto" position so that the control unit 200 operates in its automatic mode. The steps in this automatic cycle may be seen with reference to FIG. 21, which shows the sequence of operations in the automatic cycle.

To begin the automatic cycle, the operator only actuates the auto cycle start switch 206. This begins step 301. In response to the actuation of this signal, the control unit 200 initiates the delay cycle start timer 224. When the delay cycle start timer 224 times out, step 302 begins. The control unit 200 provides a signal indicating the retract-to-metal speed A on the line 216 to the motor control circuit 215. The ladle transport assembly retracts toward the metal in the furnace F at the retract-to-metal speed, as shown in FIG. 3. The ladle transport assembly will stop retracting either when the metal level sensing probes 91,91 detect the presence of metal or when the low-metal-level limit switch 151 is made. If the low-metal-level limit switch 151 is made before the probes 91,91 sense metal, the unit will go into a low-metal-level abort sequence, which will be described later with reference to step 312.

If, however, the metal level sensing probes 91 and 92 detect the presence of metal before the low-metal-level limit switch 151 is made, the control unit will continue to step 303. When the metal level sensing probes 92, 92 make, the dipper-fill timer 225 is initiated. While the dipper-fill timer 225 is running, if the metal level rises enough to touch the high metal level sensing probe 93, the control unit 200 will cause the ladle transport assembly to move forward at speed B until all of the metal level sensing probes 91, 92, and 93 are out of the metal. The ladle transport assembly will then be retracted at the retract-to-metal speed A until the metal level probes 91 and 92 again touch and the dipper-fill timer 225 will be reinitiated.

After the dipper-fill timer 225 times out, step 304 is performed. The control unit 200 sends a signal on line 216 designating the dipper-fill speed B, and the ladle transport assembly will move forward until it reaches the spill-off position (a). The spill-off position (a) is a programmed position and is achieved when the preset count loaded into the counter 201 is counted down to zero by the pulses from the encoder 150. When the spill-off position (a) is reached, step 305 is started. The spill-off timer 226 is initiated, and the ladle transport assembly stops for the amount of time set by this timer.

Figure 5:
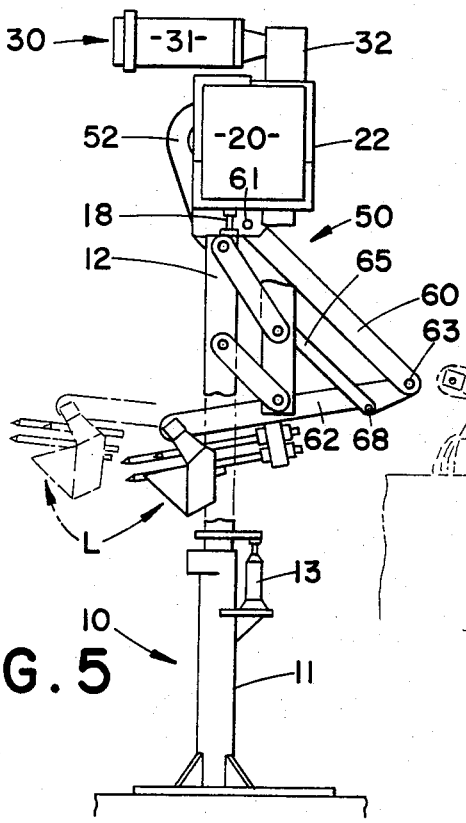

When the spill-off timer 226 times out, step 306 begins. The control unit 200 sends a signal on the line 216 indicating the forward-to-pour speed C, and the ladle transport assembly moves forward, as shown in FIG. 5. The ladle transport assembly continues forward until it reaches the ready-to-pour position, as indicated by the limit switch 156. When the limit switch 156 is made, the control unit 200 checks to see whether the dies are closed and locked and the plunger is retracted in the die casting machine D. This is indicated by the signals on lines 211, 212, and 213. If the control unit 200 receives a die-open signal or if it does not receive a die-locked signal or a plunger-retracted signal, it performs step 307 and initiates the abort-cycle timer 227. If the abort-cycle timer 227 times out before the die-locked and plunger-retracted signals are received, the control unit 200 will go into a no-pour abort sequence, which will be described later with reference to steps 313 and 314. If the die-locked or the plunger-retracted signals are broken, or a die-opened signal is received while the apparatus is pouring metal, the ladle transport assembly will again stop and the abort-cycle timer 227 will be reinitiated.

Figure 6:
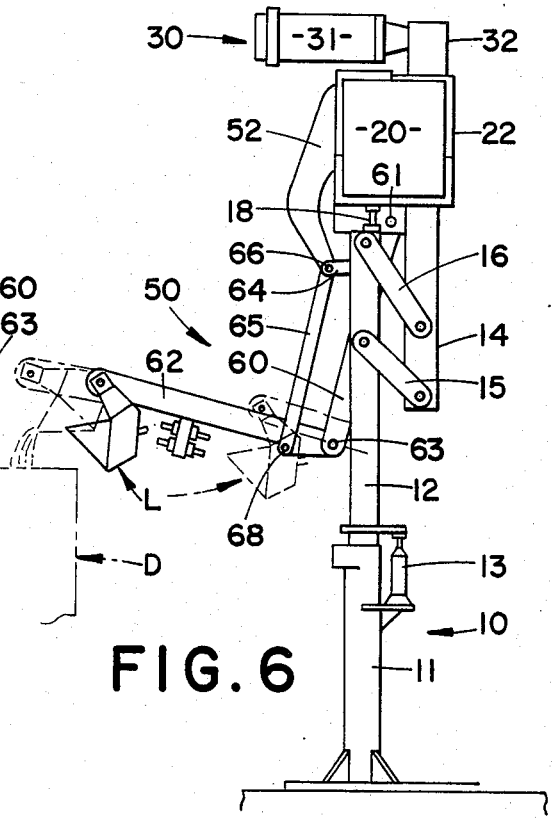

If the die-locked and plunger-retracted signals are received by the control unit 200 after the ready-to-pour limit switch 156 is made, step 308 will be performed, and the ladle dipper L will begin pouring, as indicated in FIG. 6. The control unit 200 will indicate the first pour speed D on the line 216 and the ladle transport assembly will move forward at the first pour speed until it reaches the first pour position (b). The first pour position (b) is a programmable position determined by the encoder 150. When the transport assembly reaches the first pour position (b), step 309 is begun. The control unit 200 changes the speed signal on the line 216 to the second pour speed E, and the transport assembly continues forward at the second pour speed until it reaches the second pour position (c), as indicated by the encoder 150. At this time, step 310 is performed. The control unit 200 changes to the third pour speed F, and the third pour speed is used until the unit reaches the forwardmost position or third pour position (d).

When the unit reaches the third pour position (d), as indicated by the zero count in the counter 202 being fed by the encoder 150, step 311 is started. The control unit 200 sends a signal on the line 216, indicating the retract-to-rest speed G, and the ladle transport assembly begins retracting. If selected, the control unit 200 will now give an early start cycle signal to the die casting machine D on line 228. If the early start cycle signal is not selected, the control unit 200 will not give a start cycle signal to the die casting machine D until the ready-to-pour limit switch 156 is off and the ladle transport assembly has retracted past the ready-to-pour position. The transport assembly continues to retract at speed G until it reaches the rest position (e), which is determined by the encoder 150. The control unit 200 then stops the ladle transport assembly and waits for a start signal. When a start signal is received, the delay-cycle-start timer 224 initiates, as in step 301. When the delay-cycle-start timer 224 times out, the automatic cycle is repeated, beginning with step 302.

If during step 302 the low-metal-level limit switch 151 is made before the probes 91 and 92 detect metal, then a low-metal-level abort sequence is performed. This sequence comprises step 312. In this sequence, the ladle transport assembly will stop retracting and a low-metal-level indicator light will be turned on in the control panel display 226. The control unit 200 will feed a signal on the line 216 indicating speed B, and the ladle transport assembly will move forward until it reaches the abort-rest position (f), as indicated by the counting out of the signal from the encoder 150. The transport assembly will wait in this position for a start signal.

If during step 307 the abort-cycle timer 227 times out, the control unit 200 will send a signal on the line 216 indicating the retract-to-metal speed A to the motor control circuit 215, and the ladle transport assembly will retract until the metal level sensing probes 91, 92 touch the metal in the furnace F. Step 314 will then be performed. The control unit 200 will energize the dump solenoid 132, causing the ladle dipper L to tilt forward as previously described. The control unit 200 will then indicate the forward speed B on the line 216 and the ladle transport assembly will move forward and the ladle dipper L will move upwardly out of the metal as it pours the metal back into the furnace F. The ladle transport assembly will continue to move forward to the abort-rest position (f), as indicated by the output of the encoder 150, and the control unit 200 will wait for the next start signal to begin step 301. The control unit 200 will maintain the solenoid 132 energized so that the ladle dipper L will stay in the "dump" position until the metal level sensing probes 91,92 touch the metal again.

Various modifications may be made to the control system. For example, more or fewer resistors 243 and 248 may be used to create more or fewer incremental speed adjustments. If more speed adjustments are used, the potentiometer 241 may be eliminated. While three different pouring speeds are disclosed, more or fewer pouring speeds may be utilized, each separated by a programmed intermediate pouring position.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. Apparatus for transporting a charge of molten metal from a furnace to a casting means and for pouring said charge into a receiver for said casting means, comprising:

a support assembly;

a ladle dipper;

a crankshaft journaled in said support assembly;

drive means for turning said crankshaft in forward and reverse directions;

a crank arm fixed to said crankshaft;

a generating arm pivotally connected at one end to said crank arm;

link means operatively connected between said generating arm and said support assembly whereby the other end of said generating arm defines a predetermined motion path in response to turning of said crank arm;

a main link connected at one end to said support assembly for pivotal movement about a main axis parallel to the axis of said crankshaft;

a carrier link pivotally connected at its inner end to the other end of said main link and adapted to support said ladle dipper at its outer end for pivotal movement relative thereto about a tilt axis parallel to said main axis;

means operatively connecting said other end of said generating arm to both said main link and said carrier link whereby in response to movement of said generating arm said main link and said carrier link are operable to transport said ladle dipper in forward and reverse directions through a controlled path of travel between a fill position wherein said ladle dipper is lowered into a furnace reservoir to receive a charge of molten metal and wherein said carrier link is generally vertical, and a pour position wherein said ladle dipper is over said receiver for said casting means and wherein said carrier link is generally horizontal; and means for controlling the attitude of said ladle dipper relative to said tilt axis.

2. Apparatus as defined in claim 1, wherein said link means comprises a rocking link connected at one end to said support assembly for pivotal movement about an axis parallel to the axis of said crankshaft and pivotally connected at its other end to said generating arms intermediate the ends thereof.

3. Apparatus as defined in claim 1, wherein said means connecting said generating arm to said main link and said carrier link comprises:

a first transfer link pivotally connected at one end to said main link intermediate its ends and at the other end to said generating arm; and a second transfer link pivotally connected at one end to said carrier link intermediate its ends and at its other end to said generating arm and said first transfer link.

4. Apparatus as defined in claim 3, wherein said first transfer link extends generally parallel to said carrier link and said second transfer link extends generally parallel to said main link.

5. Apparatus as defined in any of claims 1, 2 or 4 wherein said controlled path of travel of said ladle dipper comprises a generally horizontal portion extending to said pour position and a downwardly curved generally vertical portion extending at the lower end thereof to said fill position.

6. Apparatus as defined in any of claims 1, 2 or 4 wherein said predetermined motion path defined by said generating arm comprises a generally horizontal portion and a downwardly curved generally vertical portion extending from one end of said horizontal portion.

7. Apparatus as defined in any of claims 1 or 2 wherein said drive means includes a Geneva motion mechanism wherein said ladle dipper approaches null conditions at opposite ends of said controlled path of travel.

8. Apparatus as defined in claim 1, wherein said means for controlling the attitude of said ladle dipper comprises a dipper sprocket means operatively connected to said ladle dipper for pivotal movement therewith about said tilt axis and chain-and-sprocket means operatively associated with said main link and said carrier link and operatively connected to said dipper sprocket means; and means connecting said chain-and-sprocket means to said support assembly whereby said dipper sprocket means is operable to maintain said ladle dipper in a generally fixed attitude during movement of said main link and said carrier link.

9. Apparatus as defined in claim 8, wherein said attitude controlling means includes means for tilting said ladle dipper to pour molten metal therefrom.

10. Apparatus as defined in claim 9, wherein said means for tilting said ladle dipper is operatively associated with said crankshaft whereby as said crankshaft turns sufficiently to transport said ladle dipper forward to approximately said pour position, said ladle is tilted in response to further turning of said crankshaft to cause pouring of molten metal therefrom into said receiver.

11. Apparatus for transporting a charge of molten metal from a furnace to a casting means and for pouring said charge into a receiver for said casting means, comprising:

a support assembly;

a ladle dipper;

a crankshaft journaled in said support assembly;

drive means for turning said crankshaft in forward and reverse directions;

a crank arm fixed to said crankshaft;

a generating arm pivotally connected at one end to said crank arm;

a rocking link connected at one end to said support assembly for pivotal movement about an axis parallel to the axis of said crankshaft and pivotally connected at its other end to said generating arm intermediate the ends thereof whereby the other end of said generating arm defines a predetermined motion path in response to turning of said crank arm;

a main link connected at one end to said support assembly for pivotal movement about a main axis parallel to the axis of said crankshaft;

a carrier link pivotally connected at its inner end to the other end of said main link and adapted to support said ladle dipper at its outer end for pivotal movement relative thereto about a tilt axis;

means operatively connecting said other end of said generating arm to said main link and said carrier link whereby in response to turning of said crankshaft said main link and said carrier link carry said ladle dipper in forward and reverse directions through a controlled path of travel between a fill position wherein said ladle dipper is lowered into a furnace reservoir to receive a charge of molten metal and a pour position wherein said ladle dipper is over a receiver for said casting means; and means for controlling the attitude of said ladle dipper relative to said tilt axis and including means for tilting said ladle dipper to pour molten metal therefrom into said receiver as said ladle dipper reaches said pour position.

12. Apparatus as defined in claim 11, wherein said means for controlling the attitude of said ladle dipper comprises a dipper sprocket means mounted at said outer end of said carrier link and operatively connected to said ladle dipper for pivotal movement therewith about said tilt axis, and chain-and-sprocket means operatively associated with said main link and said carrier link and operatively connected to said dipper sprocket means, and means connecting said chain-and-sprocket means to said support assembly whereby said dipper sprocket means is operable to maintain said ladle dipper in a generally fixed attitude during movement of said main link and said carrier link and to tilt said ladle dipper to pour molten metal therefrom.

13. Apparatus as defined in claim 12, wherein said means for tilting said ladle dipper is operatively associated with said crankshaft whereby as said crankshaft turns sufficiently to transport said ladle dipper forward to approximately said pour position, said ladle is tilted in response to further turning of said crankshaft to cause pouring of molten metal therefrom into said receiver.

14. Apparatus as defined in claim 13, wherein said chain-and-sprocket means includes a control sprocket mounted in said support assembly for movement about said main axis and wherein said means for connecting said chain-and-sprocket means to said support assembly includes a dipper crank arm operatively connected to and adapted to turn said sprocket about said main axis, means for holding said dipper crank arm in a controlled position relative to said support assembly while said ladle dipper is transported intermediate its fill and pour positions, tilt control link means operatively connected to said dipper crank arm and operable to pivot said dipper crank arm to tilt said ladle dipper to cause pouring and dog means carried by said crankshaft and engageable with said tilt link means to cause pivoting of said dipper crank arm.

15. Apparatus as defined in claim 14, wherein said means for holding said dipper crank arm in a controlled position comprises cam means including a cam surface formed on said tilt control link means and a cam roller mounted on said rocking link, and means urging said tilt control link against said cam roller.

16. Apparatus as defined in claim 15, including means for pivoting said dipper crank arm to tilt said ladle dipper when at a position over said furnace to pour molten metal contained therein back into said furnace in response to an abort condition.

17. Apparatus for transporting a charge of molten metal from a furnace to a casting means, comprising:

an upright base tube;

an upper tube slidably received in said base tube;

an elongated, generally upright support member mounted adjacent said upper tube;

a ladle dipper;

ladle dipper transport means mounted on said support member and being adapted to transport said ladle dipper in forward and reverse directions through a controlled path of travel between a fill position wherein said ladle dipper is lowered into a furnace reservoir to receive a charge of molten metal and a pour position wherein said ladle dipper is over a receiver for said casting means;

drive means mounted on said support member for operating said ladle dipper transport means;

means for raising and lowering said upper tube relative to said base tube for adjusting the vertical position of said ladle dipper transport means and thus said controlled path of travel; and link means adjustably connecting said support member to said upper tube whereby said support member is adapted to tilt relative to said upper tube about a point generally corresponding to said fill portion, and means for adjusting the position of said support member relative to said upper tube, for adjusting the angular position of said controlled path of travel relative to said fill position whereby to adjust the vertical location of said pour position relative to said fill position.

* * * * *